US008374381B2

(12) United States Patent
Wang et al.

(10) Patent No.: US 8,374,381 B2
(45) Date of Patent: Feb. 12, 2013

(54) DIAPHRAGM AND LOUDSPEAKER USING THE SAME

(75) Inventors: Jia-Ping Wang, Beijing (CN); Liang Liu, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 257 days.

(21) Appl. No.: 12/824,417

(22) Filed: Jun. 28, 2010

(65) Prior Publication Data

US 2011/0075881 A1 Mar. 31, 2011

(30) Foreign Application Priority Data

Sep. 30, 2009 (CN) ..... 2009 1 0190571

(51) Int. Cl.

| | |
|---|---|
| ***H04R 1/02*** | (2006.01) |
| ***H04R 1/00*** | (2006.01) |
| ***H04R 9/06*** | (2006.01) |
| ***H04R 11/02*** | (2006.01) |

(52) U.S. Cl. ..... 381/423; 977/742; 977/949

(58) Field of Classification Search ..... 977/742, 977/902, 949; 381/394, 413, 423–433
See application file for complete search history.

(56) References Cited

U.S. PATENT DOCUMENTS

| | | | | |
|---|---|---|---|---|
| 4,312,118 | A | 1/1982 | Saik et al. | |
| 6,597,798 | B1 * | 7/2003 | Nakazono et al. | 381/410 |
| 6,639,993 | B2 * | 10/2003 | Kemmerer et al. | 381/397 |
| 6,808,746 | B1 | 10/2004 | Dai et al. | |
| 7,045,108 | B2 | 5/2006 | Jiang et al. | |
| 7,437,938 | B2 * | 10/2008 | Chakraborty | 73/714 |
| 8,068,626 | B2 * | 11/2011 | Jiang et al. | 381/164 |
| 8,073,164 | B2 * | 12/2011 | Jiang et al. | 381/164 |
| 2004/0020681 | A1 | 2/2004 | Hjortstam et al. | |
| 2004/0053780 | A1 | 3/2004 | Jiang et al. | |
| 2007/0166223 | A1 | 7/2007 | Jiang et al. | |
| 2008/0248235 | A1 | 10/2008 | Feng et al. | |
| 2008/0260188 | A1 * | 10/2008 | Kim | 381/190 |
| 2008/0304694 | A1 | 12/2008 | Hayashi | |
| 2009/0045005 | A1 * | 2/2009 | Byon et al. | 181/167 |

(Continued)

FOREIGN PATENT DOCUMENTS

| | | |
|---|---|---|
| CN | 1270488 | 10/2000 |
| CN | 2488247 | 4/2002 |

(Continued)

OTHER PUBLICATIONS

"Flexible, Stretchable, Transparent Carbon Nanotube Thin Film Loudspeakers" Lin Xiao et al, Nano Letters, Oct. 29, 2008.*

(Continued)

*Primary Examiner* — Jeffrey Donels
(74) *Attorney, Agent, or Firm* — Altis Law Group, Inc.

(57) ABSTRACT

A diaphragm includes carbon nanotube wire structures. The carbon nanotube wire structures are crossed with each other and woven together to form the diaphragm with a sheet structure. Each of the carbon nanotube wire structures includes carbon nanotube wires substantially parallel to each other, and closely arranged along an axis of the carbon nanotube wire structure to form a bundle-like structure, or carbon nanotube wires twisted with each other around an axis of the carbon nanotube wire structure in a helical manner to form a twisted structure. A loudspeaker using the diaphragm is also disclosed.

16 Claims, 12 Drawing Sheets

U.S. PATENT DOCUMENTS

| | | | | |
|---|---|---|---|---|
| 2009/0068448 | A1 | 3/2009 | Liu et al. | |
| 2009/0074228 | A1 | 3/2009 | Mango, III et al. | |
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |
| 2009/0197082 | A1 | 8/2009 | Jiang et al. | |
| 2009/0220767 | A1 | 9/2009 | Schlögl et al. | |
| 2009/0268559 | A1* | 10/2009 | Jiang et al. | 367/140 |
| 2009/0272935 | A1 | 11/2009 | Hata et al. | |
| 2009/0296528 | A1* | 12/2009 | Jiang et al. | 367/140 |
| 2010/0046784 | A1* | 2/2010 | Jiang et al. | 381/386 |
| 2010/0188934 | A1* | 7/2010 | Qian et al. | 367/140 |

FOREIGN PATENT DOCUMENTS

| | | |
|---|---|---|
| CN | 1430785 | 7/2003 |
| CN | 2583909 | 10/2003 |
| CN | 1640923 | 7/2005 |
| CN | 101239712 | 8/2008 |
| CN | 101288336 | 10/2008 |
| CN | 101304945 | 11/2008 |
| CN | 101321410 | 12/2008 |
| CN | 101381071 | 3/2009 |
| CN | 101464759 | 6/2009 |
| CN | 101499328 | 8/2009 |
| JP | 60-27298 | 2/1985 |
| JP | 63-49991 | 12/1988 |
| JP | 7-138838 | 5/1995 |
| JP | 2002-171593 | 6/2002 |
| JP | 2002-542136 | 12/2002 |
| JP | 2003-319490 | 11/2003 |
| JP | 2004-32425 | 1/2004 |
| JP | 2004-107196 | 4/2004 |
| JP | 2006-147801 | 6/2006 |
| JP | 2007-182352 | 7/2007 |
| JP | 2007-290908 | 11/2007 |
| JP | 2009-144158 | 7/2009 |
| JP | 2009-146420 | 7/2009 |
| JP | 2009-184910 | 8/2009 |

OTHER PUBLICATIONS

"Nanotubes made of carbon find an unexpected use" The Economist, Nov. 20, 2008.*

"Hot nanotube sheets produce music on demand" New Scientist, Oct. 31, 2008.*

Xiao et al.,Flexible, Stretchable, Transparent Carbon Nanotube Thin Film Loudspeakers,Nanoletter, vol. 8; No. 12, 4539-4545.

* cited by examiner

DIAPHRAGM AND LOUDSPEAKER USING THE SAME

CROSS-REFERENCE TO RELATED APPLICATIONS

This application claims all benefits accruing under 35 U.S.C. §119 from China Patent Application No. 200910190571.5, filed on 2009 Sep. 30, in the China Intellectual Property Office, the disclosure of which is incorporated herein by reference.

BACKGROUND

1. Technical Field

The present disclosure relates to diaphragms and loudspeakers and, particularly, to a diaphragm based on carbon nanotubes and a loudspeaker using the same.

2. Description of Related Art

A loudspeaker is an acoustic device transforming received electric signals into sounds. There are different types of loudspeakers that can be categorized by their working principle, such as electro-dynamic loudspeakers, electromagnetic loudspeakers, electrostatic loudspeakers and piezoelectric loudspeakers. Among the various types, the electro-dynamic loudspeakers have simple structures, good sound qualities, low costs, and are most widely used.

The electro-dynamic loudspeaker typically includes a diaphragm, a bobbin, a voice coil, a damper, a magnet, and a frame. The voice coil is an electrical conductor placed in the magnetic field of the magnet. By applying an electrical current to the voice coil, a mechanical vibration of the diaphragm is produced by the interaction between the electromagnetic field produced by the voice coil and the magnetic field of the magnets, thus producing sound waves by kinetically pushing the air. The diaphragm reproduces the sound pressure waves, corresponding to the original input electric signals.

To evaluate the loudspeaker, sound volume is a decisive factor. The sound volume of the loudspeaker relates to the input power of the electric signals and the conversion efficiency of the energy. However, when the input power is increased to certain levels, the diaphragm could deform or even break, thereby causing audible distortion. Therefore, the strength and Young's modulus of the diaphragm are determining factors of a rated power of the loudspeaker. The rated power is the highest input power by which the loudspeaker can produce sound without audible distortion. Additionally, the lighter the weight per unit area of the diaphragm, the smaller the energy required for causing the diaphragm to vibrate, the higher the energy conversion efficiency of the loudspeaker, and the higher the sound volume produced by the same input power.

Accordingly, the higher the strength and the Young's modulus, the smaller the density of the diaphragm, the higher the efficiency and volume of the loudspeaker.

However, the material of the diaphragm is usually polymer, metal, ceramic, or paper. The polymer and the paper have relatively low strength and Young's modulus. The metal and ceramic have relatively high weight. Therefore, the rated power of the conventional loudspeakers is relatively low. In general, the rated power of a small sized loudspeaker is only 0.3 W to 0.5 W. In another aspect, the density of the conventional diaphragms is usually large, thereby restricting the energy conversion efficiency. Therefore, to increase the rated power and the energy conversion efficiency of the loudspeaker and to increase the sound volume, the improvement of the loudspeaker is focused on increasing the strength and Young's modulus and decreasing the density of the diaphragm. Namely, the specific strength (i.e., strength/density) and the specific Young's modulus (i.e., Young's modulus/density) of the diaphragm must be increased.

Carbon nanotubes (CNT) are a novel carbonaceous material having extremely small size, light weight, and extremely large specific surface area. Carbon nanotubes have received a great deal of interest since the early 1990s and have been widely used in a plurality of fields, because of their interesting and potentially useful electrical and mechanical properties. A diaphragm of a loudspeaker using carbon nanotubes dispersed in a matrix material with the addition of surfactant, stearic acid or fatty acid, improves the strength of the diaphragm. However, the carbon nanotubes are in a powder form. Due to the large specific surface area of the carbon nanotube, the carbon nanotube powder aggregates easily in the matrix material. Thus, the larger the ratio of the carbon nanotubes in the matrix material, the more difficult it is to disperse the carbon nanotubes. Further, the addition of the surfactant, stearic acid or fatty acid introduces impurities into the diaphragm. The dispersion of the carbon nanotube relates to complicated reaction processes.

What is needed, therefore, is to provide a diaphragm and a loudspeaker using the same with high strength and Young's modulus.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
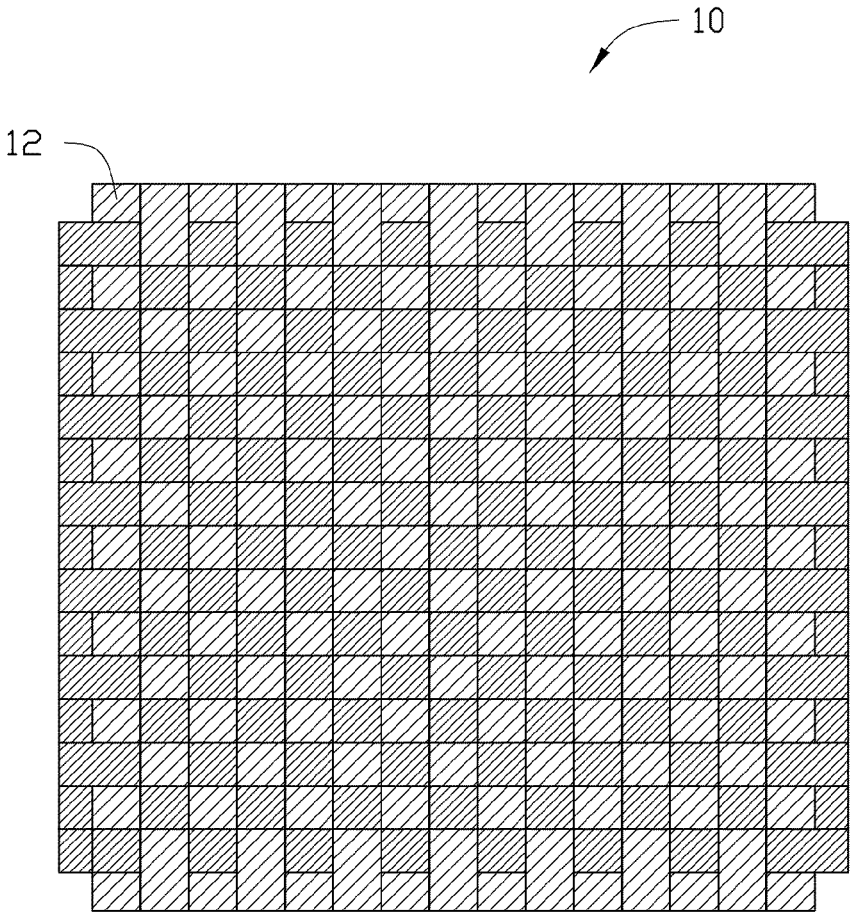
FIG. 1 is a schematic top view of an embodiment of a diaphragm including a plurality of carbon nanotube wire structures being woven together.

Referring to FIG. 1, one embodiment of a diaphragm 10 includes a plurality of carbon nanotube wire structures 12. The plurality of carbon nanotube wire structures 12 can be crossed with each other and woven together to form the diaphragm 10 with a sheet structure. The plurality of carbon nanotube wire structures 12 can be divided into two sets of the carbon nanotube wire structures. The carbon nanotube wire structures 12 in the same set are substantially parallel to each other. The two sets of the carbon nanotube wire structures 12 are crossed with each other and woven into a sheet material.

The diaphragm 10 is a freestanding structure. The term "freestanding" can be defined as a structure that does not have to be supported by a substrate. For example, a freestanding structure can sustain the weight of itself when it is hoisted by a portion thereof without any significant damage to its structural integrity. In one embodiment, the diaphragm 10 includes a plurality of carbon nanotube wire structures 12 crossed with each other and compactly woven into a freestanding sheet structure. The diaphragm 10 is a two dimensional structure with a small thickness. Although the diaphragm 10 shown in FIG. 1 has a rectangular shape, the diaphragm 10 can be cut into any other shapes, such as circular, elliptical, or triangular, to adapt to actual needs of a loudspeaker. Therefore the shape of the diaphragm 10 is not limited. In another embodiment, the diaphragm 10 can be combined with a support to strengthen the diaphragm 10.

Figure 2:
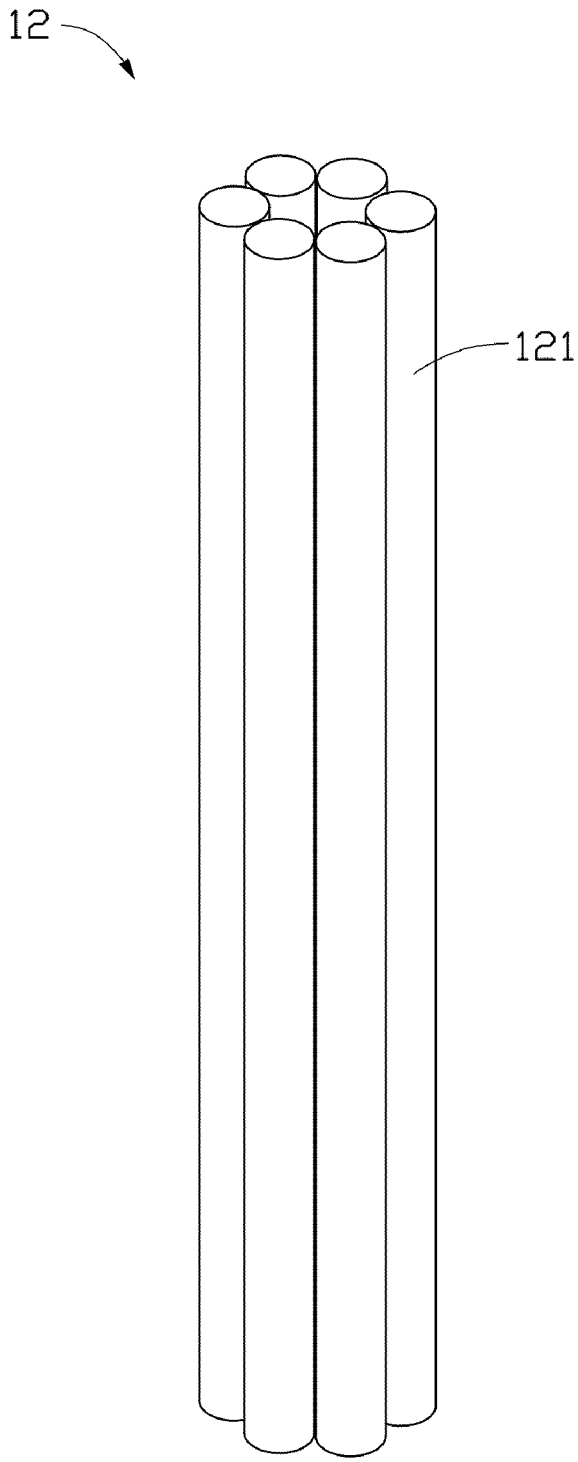
FIG. 2 is a schematic view of an untwisted linear carbon nanotube structure.
Figure 3:
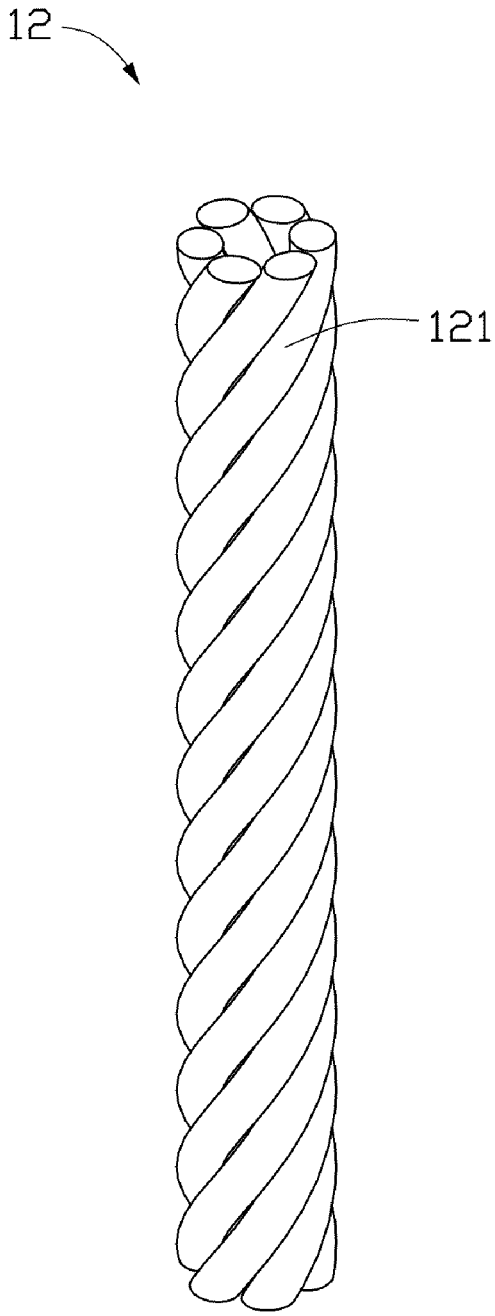
FIG. 3 is a schematic view of a twisted linear carbon nanotube structure.

Referring to FIG. 2 and FIG. 3, each of the plurality of carbon nanotube wire structures 12 includes at least one carbon nanotube wire 121. In one embodiment, as can be seen in FIG. 2, each of the plurality of the carbon nanotube wire structures 12 includes a plurality of carbon nanotube wires 121 substantially parallel to each other, and closely arranged along an axis of the carbon nanotube wire structure 12 to form a bundle-like structure. In another embodiment, as can be seen in FIG. 3, each of the plurality of the carbon nanotube wire structures 12 includes a plurality of carbon nanotube wires 121 twisted with each other around an axis of the carbon nanotube wire structure 12 in a helical manner to form a twisted structure, such that the carbon nanotube wire structure 12 can be connected tightly and has a good intensity. The carbon nanotube wire 121 of the carbon nanotube wire structure 12 can be an untwisted carbon nanotube wire or a twisted carbon nanotube wire.

The carbon nanotube wire 121 can be made of a drawn carbon nanotube film drawn from a carbon nanotube array. Examples of drawn carbon nanotube film are taught by U.S. Pat. No. 7,045,108 to Jiang et al. The drawn carbon nanotube film includes a plurality of carbon nanotubes that are arranged substantially parallel to a surface of the drawn carbon nanotube film. A large number of the carbon nanotubes in the drawn carbon nanotube film can be oriented along a preferred orientation, meaning that a large number of the carbon nanotubes in the drawn carbon nanotube film are arranged substantially along the same direction. An end of one carbon nanotube is joined to another end of an adjacent carbon nanotube arranged substantially along the same direction, by van der Waals attractive force. A small number of the carbon nanotubes are randomly arranged in the drawn carbon nanotube film, and has a small if not negligible effect on the larger number of the carbon nanotubes in the drawn carbon nanotube film arranged substantially along the same direction. The drawn carbon nanotube film is capable of forming a freestanding structure. The successive carbon nanotubes joined end to end by van der Waals attractive force realizes the freestanding structure of the drawn carbon nanotube film.

Figure 4:
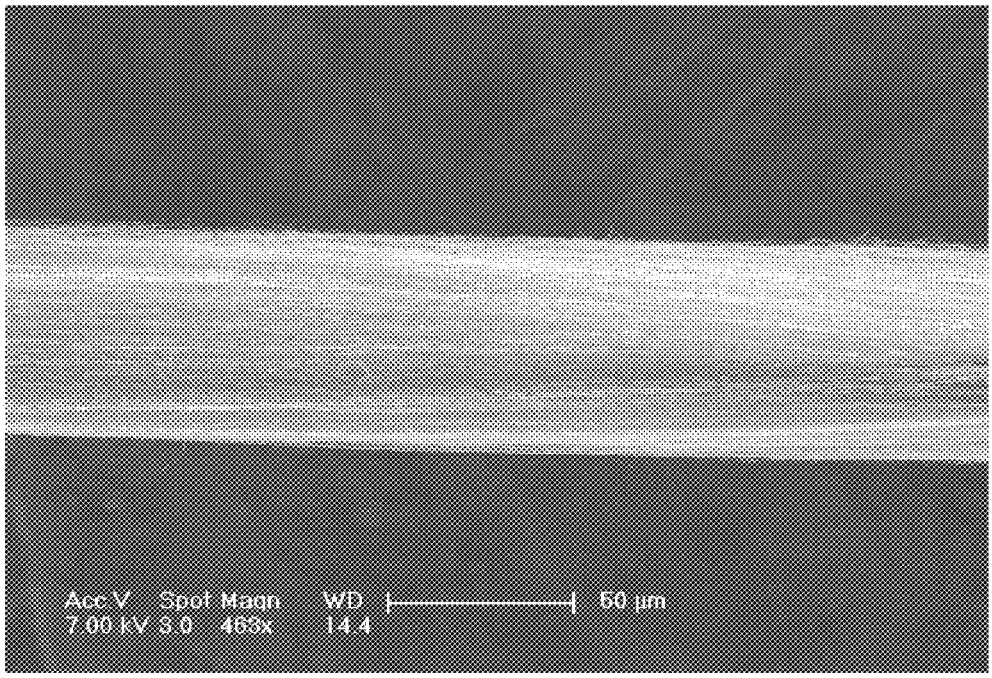
FIG. 4 is a Scanning Electron Microscope (SEM) image of an untwisted carbon nanotube wire.

Referring to FIG. 4, in one embodiment, the carbon nanotube wire 121 is an untwisted carbon nanotube wire. Treating the drawn carbon nanotube film with a volatile organic solvent can obtain the untwisted carbon nanotube wire. In one embodiment, the organic solvent is applied to soak the entire surface of the drawn carbon nanotube film. During the soaking, adjacent substantially parallel carbon nanotubes in the drawn carbon nanotube film will bundle together, due to the surface tension of the organic solvent as it volatilizes, and thus, the drawn carbon nanotube film will be shrunk into an untwisted carbon nanotube wire. The untwisted carbon nanotube wire includes a plurality of carbon nanotubes substantially oriented along a same direction (i.e., a direction along the length direction of the untwisted carbon nanotube wire). The carbon nanotubes are substantially parallel to the axis of the untwisted carbon nanotube wire. In one embodiment, the untwisted carbon nanotube wire includes a plurality of successive carbon nanotubes joined end to end by van der Waals attractive force therebetween. The length of the untwisted carbon nanotube wire can be arbitrarily set as desired. A diameter of the untwisted carbon nanotube wire ranges from about 0.5 nm to about 100 μm. An example of an untwisted carbon nanotube wire is taught by US Patent Application Publication US 2007/0166223 to Jiang et al.

Figure 5:
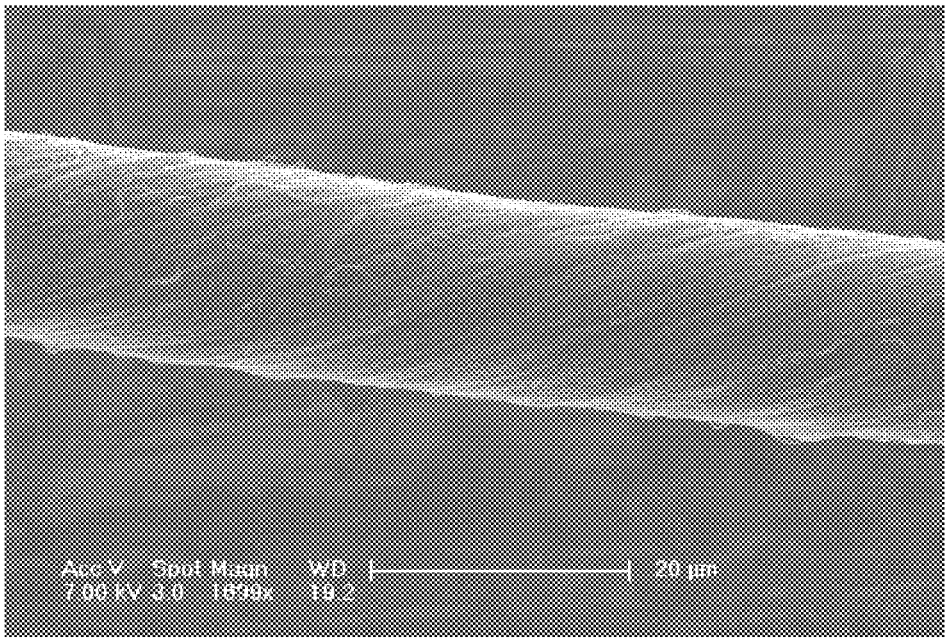
FIG. 5 is an SEM image of a twisted carbon nanotube wire.

Referring to FIG. 5, in one embodiment, the carbon nanotube wire 121 is a twisted carbon nanotube wire. The twisted carbon nanotube wire can be obtained by twisting a drawn carbon nanotube film using a mechanical force to turn the two ends of the drawn carbon nanotube film in opposite directions. The twisted carbon nanotube wire includes a plurality of carbon nanotubes helically oriented around an axial direction of the twisted carbon nanotube wire. Further, the twisted carbon nanotube wire can be treated with a volatile organic solvent, before or after being twisted. After being soaked by the organic solvent, the adjacent substantially parallel carbon nanotubes in the twisted carbon nanotube wire will bundle together, due to the surface tension of the organic solvent when the organic solvent volatilizes. The specific surface area of the twisted carbon nanotube wire will decrease, and the density and strength of the twisted carbon nanotube wire will increase. In one embodiment, the twisted carbon nanotube wire includes a plurality of successive carbon nanotubes joined end to end by van der Waals attractive force therebetween. The length of the carbon nanotube wire can be set as desired. A diameter of the twisted carbon nanotube wire can be from about 0.5 nm to about 100 μm.

The diaphragm 10 includes a plurality of carbon nanotube wire structures 12. Each of the carbon nanotube wire structures 12 includes at least one carbon nanotube wire 121. The carbon nanotube wire 121 includes a plurality of carbon nanotubes. Because the carbon nanotubes have great strength, low density, and large Young's modulus, the carbon nanotube wire 121 possess these qualities, and consequently, the diaphragm 10 will also possess the same qualities.

Figure 6:
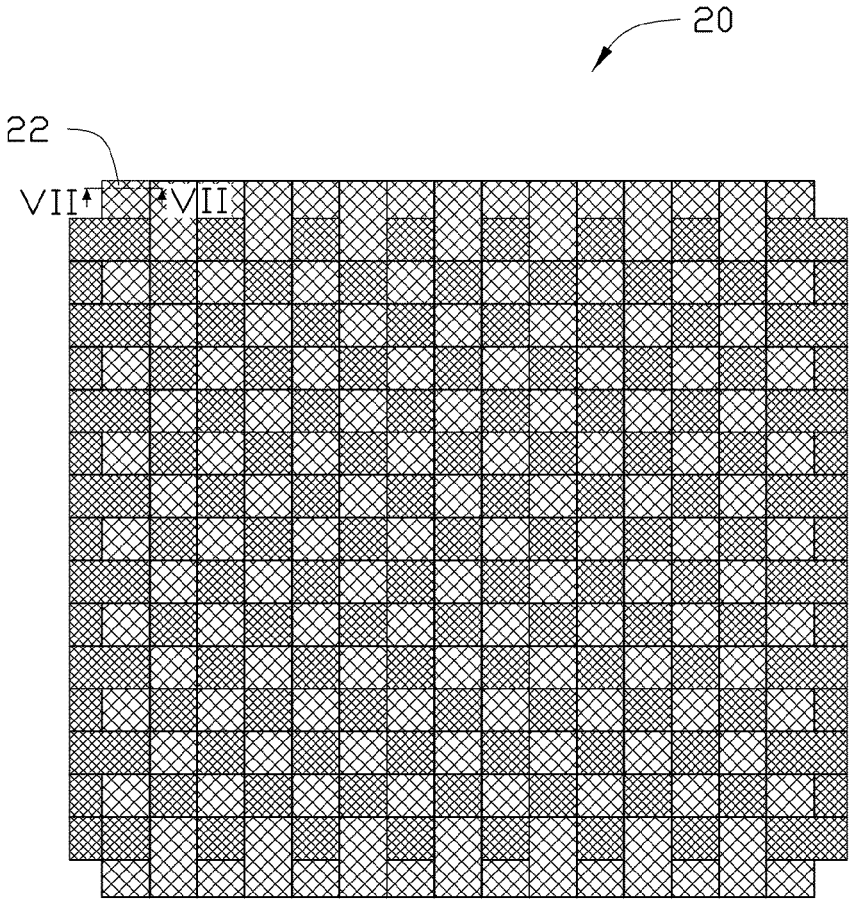
FIG. 6 is a schematic top view of another embodiment of a diaphragm including a plurality of carbon nanotube composite wire structures woven together.

Referring to FIG. 6, one embodiment of a diaphragm 20 includes a plurality of carbon nanotube composite wire structures 22. The wire structures 22 can be crossed with each other and woven together to form the diaphragm 20 with a sheet structure. The wire structures 22 can be divided into two sets of wire structures 22. The wire structures 22 in the same set are substantially parallel to each other. The two sets of the wire structures 22 are crossed with each other and woven into a sheet material.

Figure 7:
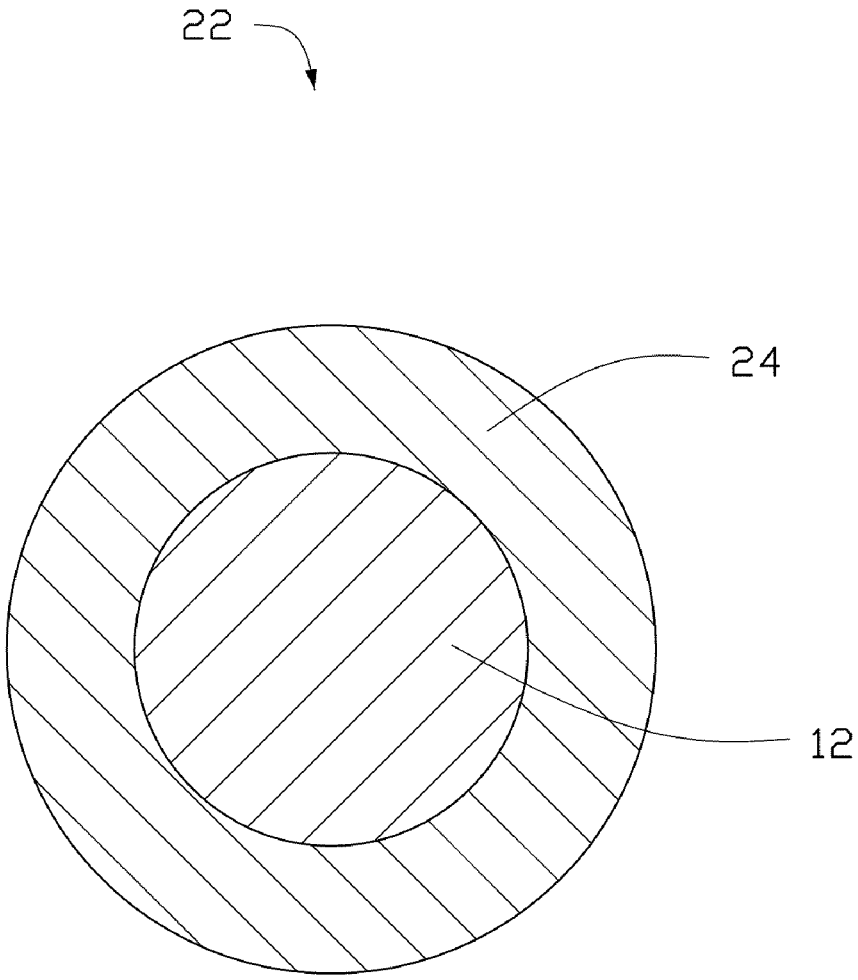
FIG. 7 is a schematic enlarged cross-sectional view, taken along a line VII-VII of FIG. 6.

Referring to FIG. 7, each of the wire structures 22 includes at least one carbon nanotube wire structure 12 surrounded by a reinforcing layer 24. The reinforcing layer 24 is coated on an outer surface of the carbon nanotube wire structure 12.

A material of the reinforcing layer 24 can be metal, diamond, ceramic, paper, cellulose, or polymer. The polymer can be polypropylene, polyethylene terephthalate (PET), polyetherimide (PEI), polyethylene naphthalate (PEN), polyphenylene sulfide (PPS), polyvinyl chloride (PVC), polystyrene (PS), or polyethersulfone (PES). The metal can be at least one of iron (Fe), cobalt (Co), nickel (Ni), palladium (Pd), titanium (Ti), copper (Cu), silver (Ag), gold (Au), platinum (Pt), or any combination thereof. The carbon nanotube wire structure 12 has a plurality of micropores, therefore, other materials can be formed on the outer surface of the side-wall of the individual carbon nanotube to form the reinforcing layer 24 by a method such as PVD, CVD, evaporation, sputtering, electroplating, and chemical plating. A plurality of reinforcing layers 24 can be formed on the outer surface of the carbon nanotube wire structure 12 in a concentric manner such that the carbon nanotube composite wire structure 22 can have a larger Young's modulus. A thickness of the reinforcing layer 24 is in a range from about 0.5 nanometers to about 5000 nanometers.

The diaphragm 20 can further include a plurality of carbon nanotube wire structures 12. The wire structures 12 and the composite wire structures 22 are crossed with each other and woven into a sheet material.

Figure 8:
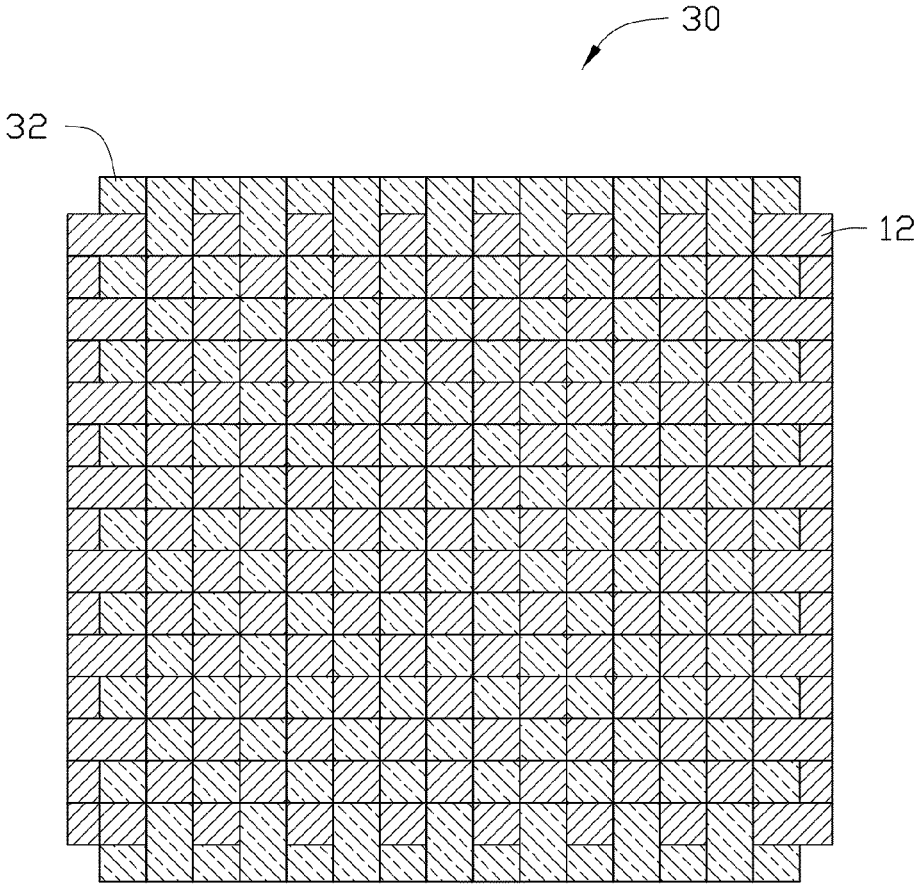
FIG. 8 is a schematic top view of another embodiment of a diaphragm including a plurality of carbon nanotube wire structures and a plurality of reinforcing wire structures crossing each other.

Referring to FIG. 8, one embodiment of a diaphragm 30 includes a plurality of carbon nanotube wire structures 12 and a plurality of reinforcing wire structures 32. The wire structures 12 are substantially parallel to each other, and the reinforcing wire structures 32 are substantially parallel to each other. The wire structures 12 are substantially perpendicular to and crossed with the reinforcing wire structures 32 and woven to form the diaphragm 30. The wire structures 12 and reinforcing wire structures 32 are compactly woven together, therefore there are less intervals between the adjacent carbon nanotube wire structures 12 and reinforcing wire structures 32.

Each of the reinforcing wire structures 32 can comprise at least one of cotton wires, fibers, polymer wires, and metal wires. The reinforcing wire structures 32 add to the strength and Young's modulus of the diaphragm 30. In one embodiment, the reinforcing wire structure 32 is a cotton wire to reduce the cost of the diaphragm 30.

Figure 9:
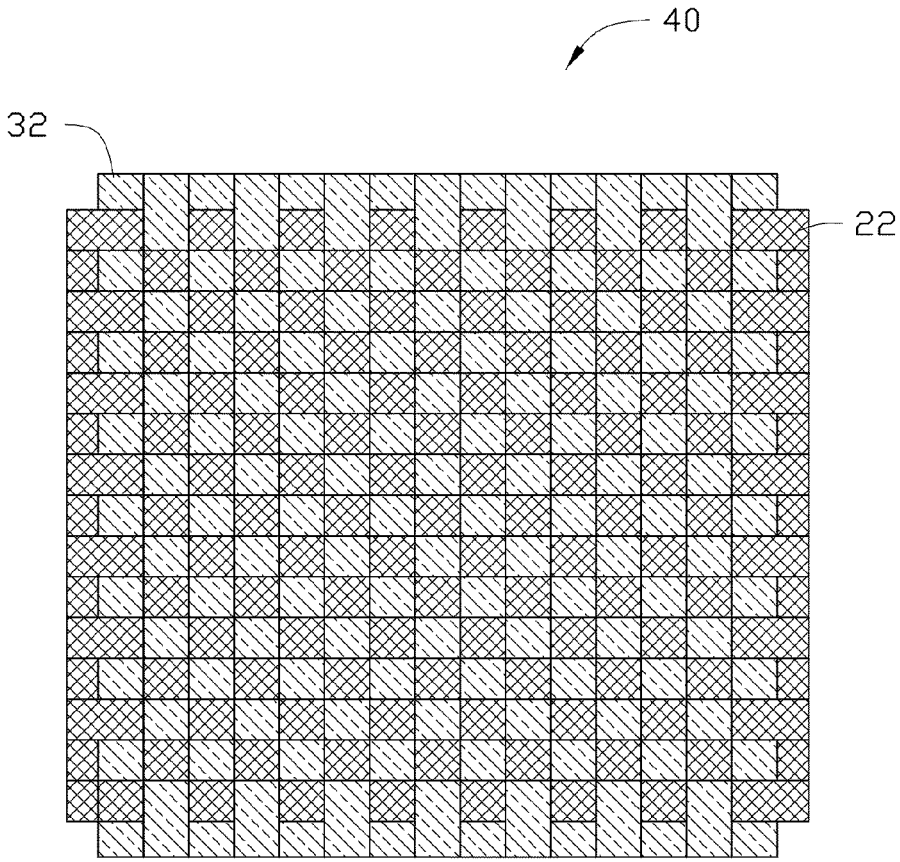
FIG. 9 is a schematic top view of another embodiment of a diaphragm including a plurality of carbon nanotube composite wire structures and a plurality of reinforcing wire structures crossing each other.

Referring to FIG. 9, another embodiment of a diaphragm 40 includes a plurality of carbon nanotube composite wire structures 22 and a plurality of reinforcing wire structures 32. The wire structures 22 are substantially parallel to each other, and the reinforcing wire structures 32 are substantially parallel to each other. The wire structures 22 are substantially perpendicular to and compactly crossed with the reinforcing wire structures 32 and woven to form the diaphragm 40.

Figure 10:
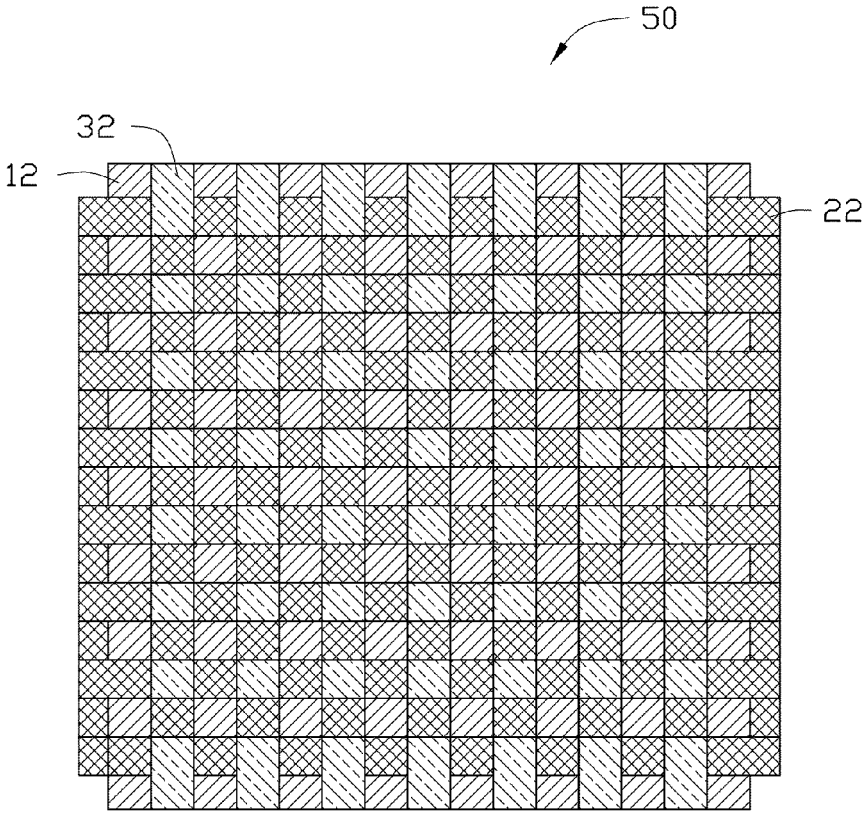
FIG. 10 is a schematic top view of another embodiment of a diaphragm including a plurality of carbon nanotube wire structures, a plurality of carbon nanotube composite wire structures, and a plurality of reinforcing wire structures woven together.

Referring to FIG. 10, one embodiment of a diaphragm 50 includes a plurality of carbon nanotube composite structures 12, a plurality of carbon nanotube composite wire structures 22, and a plurality of reinforcing wire structures 32. The composite structures 12, the wire structures 22, and the reinforcing wire structures 32 can be crossed with each other and woven into a sheet material. In one embodiment, the wire structures 22 are substantially parallel to each other, the composite structures 12 are substantially parallel to each other, and the reinforcing wire structures 32 are substantially parallel to each other. The wire structures 22 and the composite structures 12 are substantially parallel to each other and substantially perpendicular to and compactly crossed with the reinforcing wire structures 32 to weave the diaphragm 50.

Although the diaphragms shown in FIGS. 1, 6, and 8 to 10 have a rectangular shape, the diaphragms can be cut into other shapes, such as circular, elliptical, or triangular, to meet the actual needs of the loudspeaker. The shape of the diaphragms is not limited.

Figure 11:
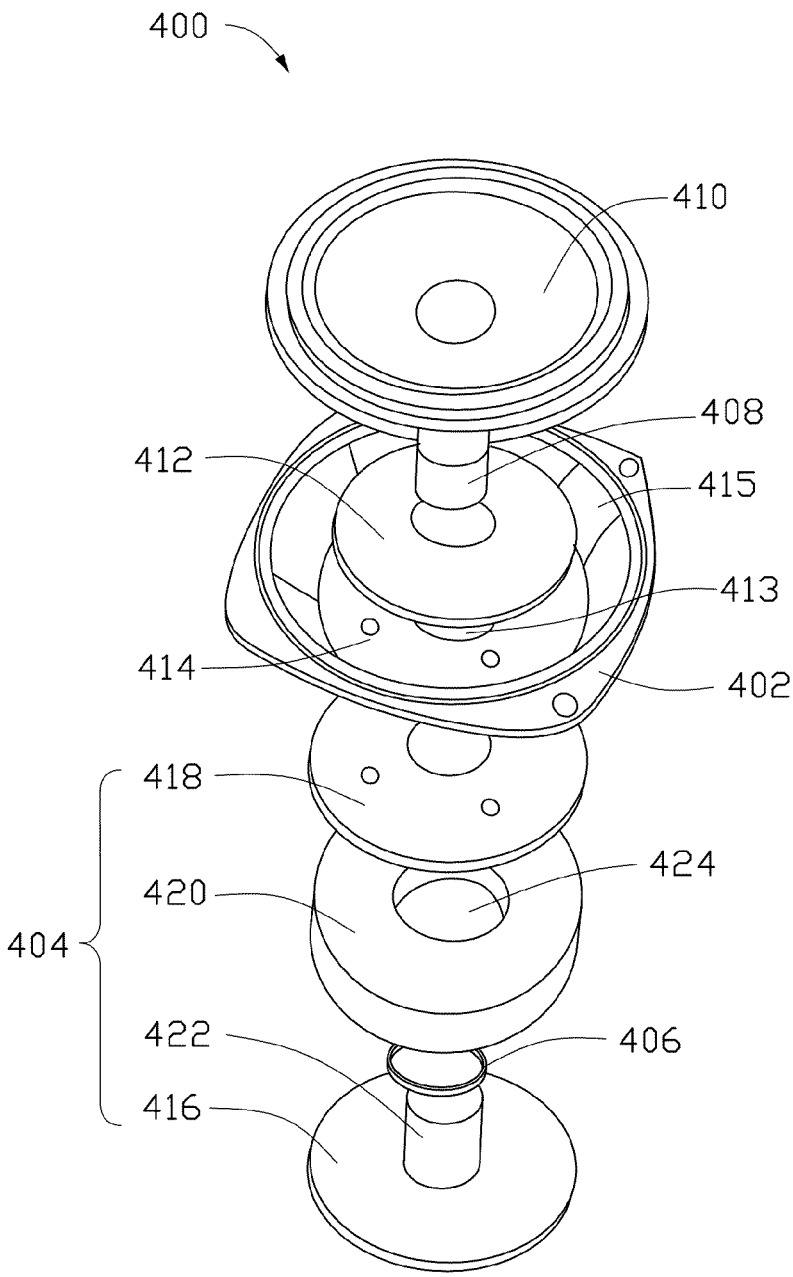
FIG. 11 is a schematic structural view of an embodiment of a loudspeaker.
Figure 12:
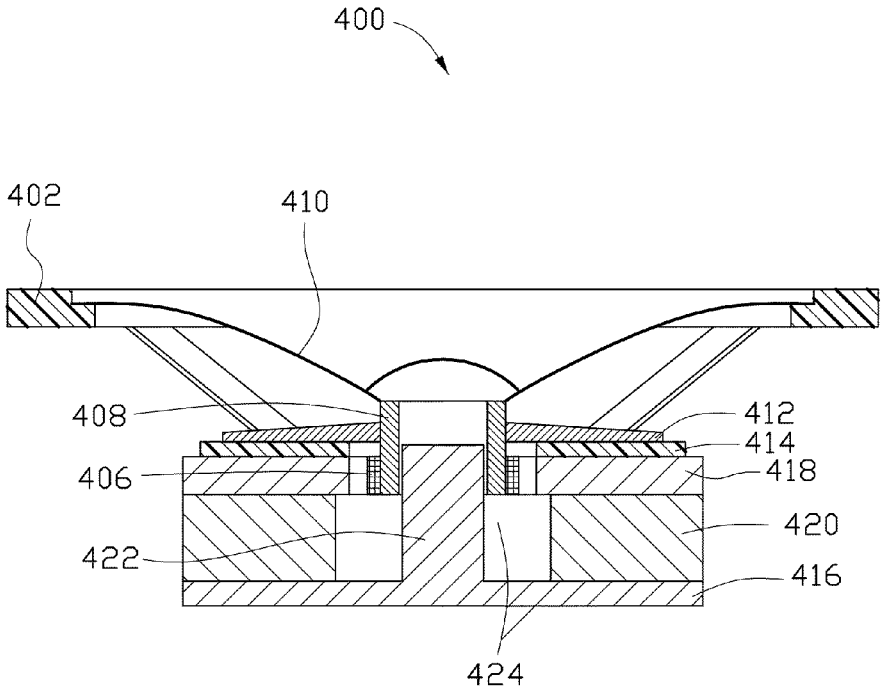
FIG. 12 is a cross-sectional view of the loudspeaker of FIG. 11.

Referring to FIGS. 11 and 12, a loudspeaker 400 using the diaphragm of the above-described embodiments, includes a frame 402, a magnetic circuit 404, a voice coil 406, a bobbin 408, a diaphragm 410, and a damper 412. The diaphragm 410 can be one of the diaphragms 10, 20, 30, 40, 50.

The frame 402 is mounted on an upper side of the magnetic circuit 404. The voice coil 406 is received in the magnetic circuit 404. The voice coil 406 is wound on the bobbin 408. An outer rim of the diaphragm 410 is fixed to an inner rim of the frame 402, and an inner rim of the diaphragm 410 is fixed to an outer rim of the bobbin 408 and placed in a magnetic gap 424 of the magnetic circuit 404.

The frame 402 is a truncated cone with an opening on one end and includes a hollow cavity 415 and a bottom 414. The hollow cavity 415 receives the diaphragm 410 and the damper 412. The bottom 414 has a center hole 413 to accommodate the center pole 422 of the magnetic circuit 404. The bottom 414 of the frame 402 is fixed to the magnetic circuit 404.

The magnetic circuit 404 includes a lower plate 416 having a center pole 422, an upper plate 418, and a magnet 420. The magnet 420 is sandwiched by the lower plate 416 and the upper plate 418. The upper plate 418 and the magnet 420 are both circular, and define a cylindrical shaped space in the magnetic circuit 404. The center pole 422 is received in the cylindrical shaped space and extends through the center hole 413. The magnetic gap 424 is formed by the center pole 422 and the magnet 420. The magnetic circuit 404 is fixed on the bottom 414 at the upper plate 418.

The voice coil 406 wound on the bobbin 408 is a driving member of the loudspeaker 400. The voice coil 406 is made of conducting wire. When an electric signal is inputted into the voice coil 406, a magnetic field is formed by the voice coil 406 by variation of the electric signal. The interaction with the magnetic field caused by the voice coil 406 and the magnetic circuit 404 produce the vibration of the voice coil 406.

The bobbin 408 is light in weight and has a hollow structure. The center pole 422 is disposed in the hollow structure and is spaced from the bobbin 408. When the voice coil 406 vibrates, the bobbin 408 and the diaphragm 410 also vibrate with the voice coil 406 to produce sound.

The diaphragm 410 is a sound producing member of the loudspeaker 400. The diaphragm 410 can have a conical shape if used in a large sized loudspeaker 400. If the loudspeaker 400 has a smaller size, the diaphragm 410 can have a planar circular shape or a planar rectangular shape.

The damper 412 is a substantially ring-shaped plate having circular ridges and circular furrows alternating radially. The damper 412 holds the diaphragm 410 mechanically. The damper 412 is fixed to the frame 402 and the bobbin 408. The damper 412 has a relatively large rigidity along the radial direction thereof, and a relatively small rigidity along the axial direction thereof, thus the voice coil can freely move up and down but not radially.

Furthermore, an external input terminal can be attached to the frame 402. A dust cap can be fixed over and above a joint portion of the diaphragm 410 and the bobbin 408.

It is to be understood that the loudspeaker 400 is not limited to the above-described structure. Any loudspeaker using the present diaphragm is in the scope of the present disclosure.

It is to be understood that the above-described embodiments are intended to illustrate rather than limit the present disclosure. Any elements described in accordance with any embodiments is understood that they can be used in addition or substituted in other embodiments. Embodiments can also be used together. Variations may be made to the embodiments without departing from the spirit of the present disclosure. The above-described embodiments illustrate the scope of the invention but do not restrict the scope of the present disclosure.

What is claimed is:

1. A diaphragm comprising a plurality of carbon nanotube wire structures crossed with each other and woven into a sheet structure, wherein each of the plurality of carbon nanotube wire structures comprises a plurality of carbon nanotube wires substantially parallel to each other and closely arranged along an axis of the carbon nanotube wire structure to form a bundle-like structure.

2. The diaphragm of claim 1, wherein the carbon nanotube wire is an untwisted carbon nanotube wire comprising a plurality of carbon nanotubes substantially oriented along a same direction, the carbon nanotubes are joined end to end by van der Waals attractive force therebetween.

3. The diaphragm of claim 1, wherein each carbon nanotube wire is a twisted carbon nanotube wire comprising a plurality of carbon nanotubes helically oriented around an axial direction of the twisted carbon nanotube wire.

4. The diaphragm of claim 1, further comprising a plurality of reinforcing wire structures, wherein the plurality of reinforcing wire structures and the plurality of carbon nanotube wire structures are crossed with each other and woven together to form the sheet structure.

5. The diaphragm of claim 4, wherein each of the plurality of reinforcing wire structures is at least one of cotton wires, fibers, polymer wires, and metal wires.

6. A diaphragm comprising:

a plurality of carbon nanotube composite wire structures crossed with each other and woven into a sheet structure, each of the plurality of carbon nanotube composite wire structures comprising at least one carbon nanotube wire structure surrounded by a reinforcing layer, wherein each of the plurality of carbon nanotube wire structures comprises a plurality of carbon nanotube wires substantially parallel to each other and closely arranged along an axis of the carbon nanotube wire structure to form a bundle-like structure.

7. The diaphragm of claim 6, wherein the reinforcing layer is coated on an outer surface of the at least one carbon nanotube wire structure.

8. The diaphragm of claim 6, wherein a material of the reinforcing layer is selected from the group consisting of metal, diamond, boron carbide, ceramic, and combinations thereof.

9. The diaphragm of claim 6, wherein the carbon nanotube wire is an untwisted carbon nanotube wire comprising a plurality of carbon nanotubes substantially oriented along a same direction, the carbon nanotubes being joined end to end by van der Waals attractive force therebetween.

10. The diaphragm of claim 6, wherein each carbon nanotube wire is a twisted carbon nanotube wire comprising a plurality of carbon nanotubes helically oriented around an axial direction of the twisted carbon nanotube wire.

11. The diaphragm of claim 6 further comprising a plurality of reinforcing wire structures, wherein the plurality of reinforcing wire structures and the plurality of carbon nanotube wire structures crossed with each other and woven together to from the sheet structure.

12. The diaphragm of claim 11, wherein each of the plurality of reinforcing wire structures is at least one of cotton wires, fibers, polymer wires, and metal wires.

13. The diaphragm of claim 6, further comprising a plurality of carbon nanotube wire structures and a plurality of reinforcing wire structures, wherein the plurality of carbon nanotube composite structures, the plurality of carbon nanotube composite wire structures, and the plurality of reinforcing wire structure are crossed with each other and woven together to form the sheet structure.

14. The diaphragm of claim 6 further comprising a plurality of carbon nanotube wire structures, wherein the plurality of carbon nanotube composite wire structures and the plurality of carbon nanotube wire structures are crossed with each other and woven together to form the sheet structure.

15. A diaphragm comprising a plurality of carbon nanotube wire structures crossed with each other and woven into a sheet structure, wherein each of the plurality of carbon nanotube wire structures comprises a plurality of carbon nanotube wires twisted with each other around an axis of the carbon nanotube wire structure in a helical manner to form a twisted structure.

16. A diaphragm comprising:

a plurality of carbon nanotube composite wire structures crossed with each other and woven into a sheet structure, each of the plurality of carbon nanotube composite wire structures comprising at least one carbon nanotube wire structure surrounded by a reinforcing layer, wherein each of the plurality of carbon nanotube wire structure comprises a plurality of carbon nanotube wires twisted with each other around an axis of the carbon nanotube wire structure in a helical manner to form a twisted structure.

* * * * *